United States Patent [19]

Kuo

[11] Patent Number: 4,858,455

[45] Date of Patent: Aug. 22, 1989

[54] LOCK CORE

[75] Inventor: Wen Tai Kuo, Tainan, Taiwan

[73] Assignee: Ming Tay Hardware Ind. Co., Ltd., Taiwan

[21] Appl. No.: 159,406

[22] Filed: Feb. 11, 1988

[51] Int. Cl.[4] ..... E05B 27/08

[52] U.S. Cl. ..... 70/491

[58] Field of Search ..... 70/363, 403, 404, 491

[56] References Cited

U.S. PATENT DOCUMENTS

| | | | |
|---|---|---|---|
| 2,089,300 | 8/1937 | Schlitz | 70/363 |
| 3,339,384 | 9/1967 | Greenwald | 70/363 |
| 3,486,353 | 12/1969 | Pilvet | 70/363 |
| 3,648,492 | 3/1972 | Walters et al. | 70/363 |
| 4,068,510 | 1/1978 | Neary | 70/379 R |

FOREIGN PATENT DOCUMENTS

| | | | |
|---|---|---|---|
| 305377 | 5/1918 | Fed. Rep. of Germany | 70/363 |
| 675510 | 7/1952 | United Kingdom | 70/363 |

*Primary Examiner*—Lloyd A. Gall

*Attorney, Agent, or Firm*—Lowe, Price, LeBlanc, Becker & Shur

[57] ABSTRACT

The improved lock core comprises a cylindrical casing receiving a rotatable spindle formed with a co-rotatable outer ring through which upper plug followers extend, biased by lower plug followers received in a lower plug non-rotatably secured to the casing with a lock pin. A pair of protuberances are formed closely adjacent each other on an upper surface of an outer ring to receive a tenon of a valid key inserted through a key hole in the cylindrical casing. The protuberances enable the key to apply rotative torque to the outer ring while a front edge of the key depresses the upper plug followers a sufficient depth enabling the outer ring and spindle to rotate relative to the lower plug.

4 Claims, 3 Drawing Sheets

LOCK CORE

BACKGROUND ART

The conventional lock core of this type utilizes a trough on top of the spindle to engage to a tenon of a key for rotating the spindle to release the locked position. However, such lock core may easily be open by any thief having ordinary skill by the use of two hard materials, with one inserted into the groove of the casing and the other into the recess of the spindle respectively, turning the two materials in two different directions by force, to illegally open the lock.

SUMMARY OF THE INVENTION

A primary object of the present invention is to provide an improved lock core, having anti-theft characteristics.

DESCRIPTION OF THE PREFERRED EMBODIMENT

Figure 1:
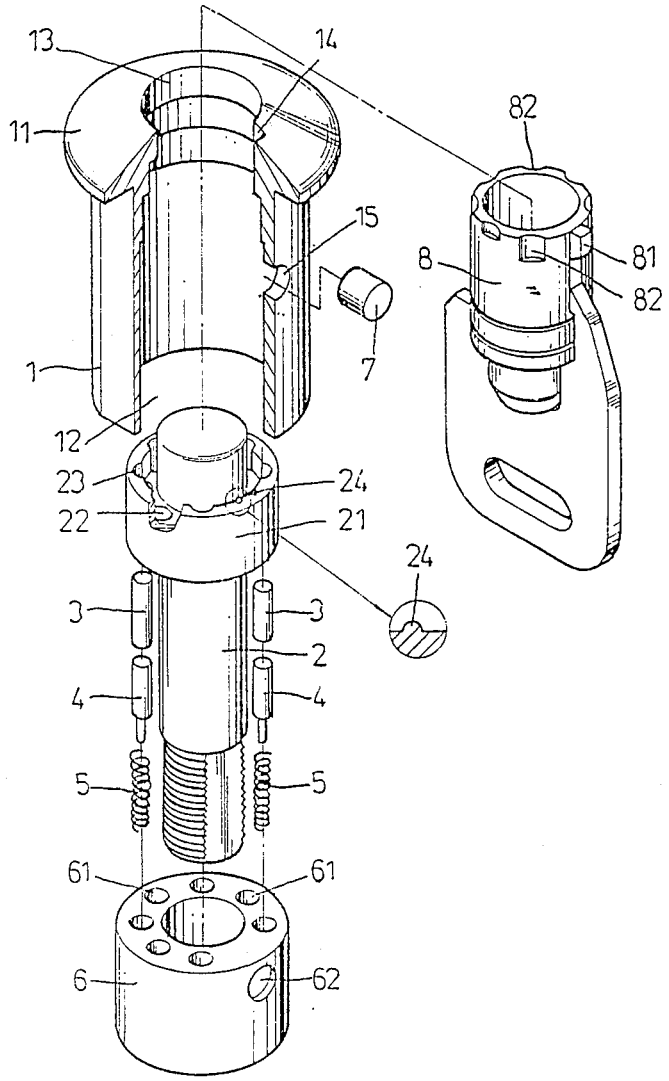
FIG. 1 is an exploded view of the present invention.

With reference to the drawings and FIG. 1 in particular, there is shown an exploded view of the present invention and a key 8. The present invention comprises a cylindrical casing 1, upper and a lower plug follower stands 21 and 6, a spindle 2, plural upper and lower plug followers 3 and 4, plural helical compression springs 5 and a pin 7. The cylindrical casing 1 has an extended rim 11 at one end and an insertion hole 12 at other end. The rim 11 has an opening 13 and with three different steps. The outer step of the opening 13 has the smallest size while the lower step of the opening 13 has the largest size. The opening 13 also has a recess 14 for the insertion of a tenon 81 of the key 8. The middle portion of the cylindrical casing 1 has a pin hole 15 for the insertion of the pin 7. The upper plug follower stand 21 is integrally formed on the upper one third of the spindle 2. The stand 21 has an outer ring 23 at its top and a plug chamber 22 inside of the outer ring 23 for the insertion of the upper plug followers 3. The inner wall of the outer ring 23 has several recesses respectively corresponding with each through bore of the upper plug followers 3 for accommodating the upper portion of the plugs 3. The top surface of the upper plug followers stand 21 has two protuberances 24 engageable with the tenon 81 of key 8. Thus, the upper plug followers stand 21 is linked with the key 8. The upper plug followers 3 are all of different length. The lower plug followers 4, on the other hand, are the same size and include smaller diameter stepped portion at a lower portion thereof to respectively receive helical compression springs 5. The bottom one third portion of the spindle 2 has a smaller diameter portion with a flat surface at one side and a serrated surface at the other side. The lower plug followers stand 6 is cylindrical and includes plural blind bores 61, each corresponding to one of the lower plug followers 4, and a circular opening 62 for the insertion of the pin 7.

The assembly procedure is as follows. First, the bottom of the lower plug followers 4 are inserted into the helical compression springs 5 and received in the blind bores 61 of the lower plug followers stand 6. Second, the upper plug followers 3 are inserted into the upper plug followers stand 21. The upper and lower plug followers stands 21 and 6 are brought together. The springs 5, because of their elastic force, will push the lower plug followers 4 upwards to urge a portion of the lower plug followers 4 into the upper plug followers stand 21. The two upper and the lower plug followers stands 21 and 6 are inserted into the cylindrical casing 1 through the insertion hole 12 and the pin 7 is inserted into the opening 62 and the pin hole 15 to complete the lock assembly.

Figure 2A:
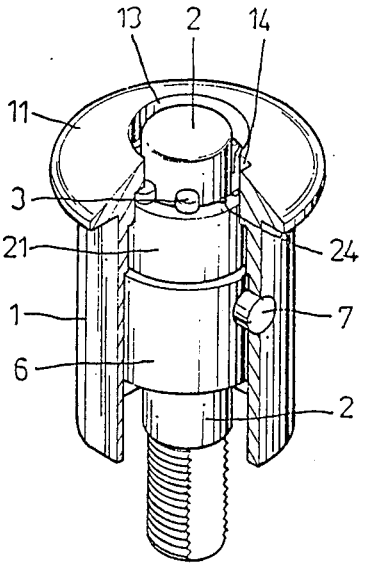
FIG. 2*a* is a perspective cross-sectional view of the present invention.

With reference now to FIG. 2*a* which shows a perspective cross-sectional view of the present invention, the lock is formed by means of a pin 7 inserted into the opening 61 through the pin hole 15. A portion of each of the upper plug followers 3 extends upward through the plug chamber 22.

Figure 2B:
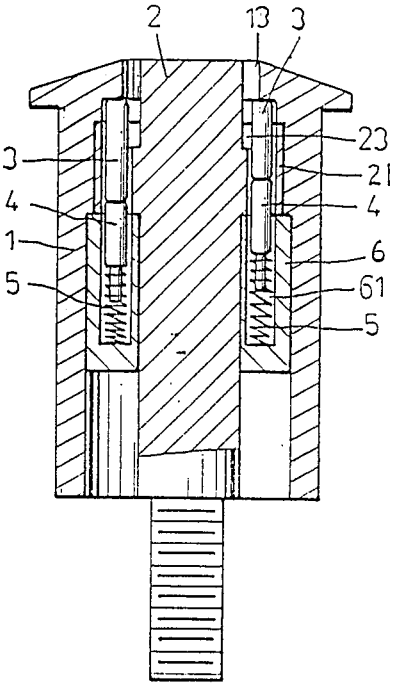
FIG. 2*b* is a plan cross-sectional view of the present invention.

Reference is now made to FIG. 2*b* which is a plan cross-sectional view of the present invention. The outer ring 23 is dimensional with respect to the steps so that upper portions of the upper plug followers 3 extending through the plug chamber 22 will have two thirds of its top surface abutting the smallest step with the other one third portion visible for depressing contact with the key 8. Since the upper plug followers 3 are all of different size, the lower plug followers 4 will have different portions inserted into the upper plug followers stand 21 by means of the pushing force of the helical compression springs 5. Thus, when a valid key is inserted into the lock, the tenon 81 of the key 8 passes through the recess 14 so that the front end of the key 8 will be contactable with the top end of the upper plug followers stand 21. The tenon 81 of the key 8, at this time, engages the two protuberances 24 of the upper plug followers stand 21 and the arc-shaped grooves 82 of the key 8 which have been cut in different length to meet the requirement of pushing the upper plug followers down to let the contact point of the two upper and lower plug followers be coplanar with the contact point of the two upper and the lower plug followers stands 21 and 6. The upper plug followers stand 21 at this point is capable of being rotated with the key 8 which will also rotate the spindle 2 to release the locked position. When the valid key 8 is pulled out, the helical compression springs 5 will push the lower plug followers up into the through bore of the upper plug followers stand 21, and the lock is again in locked position.

Figure 2C:
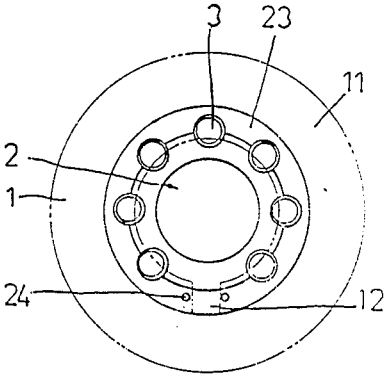
FIG. 2*c* is a top view of the present invention.

FIG. 2*c* is a top view of the present invention. When a valid key 8 is inserted into the key hole, the tenon 81 of the key 8 must be inserted through the recess 14 and will engage to the two protuberances 24, thus when rotating the key 8, the upper plug followers stand 21 and the spindle 2 will rotate simultaneously, provided that the arc-shaped grooves 82 of the legal key 8 have pushed all the upper plug followers 3 down to make the contact point between the upper and the lower plug followers 3 and 4 coplanar with the contact point of the followers stands 21 and 6.

Figure 3:
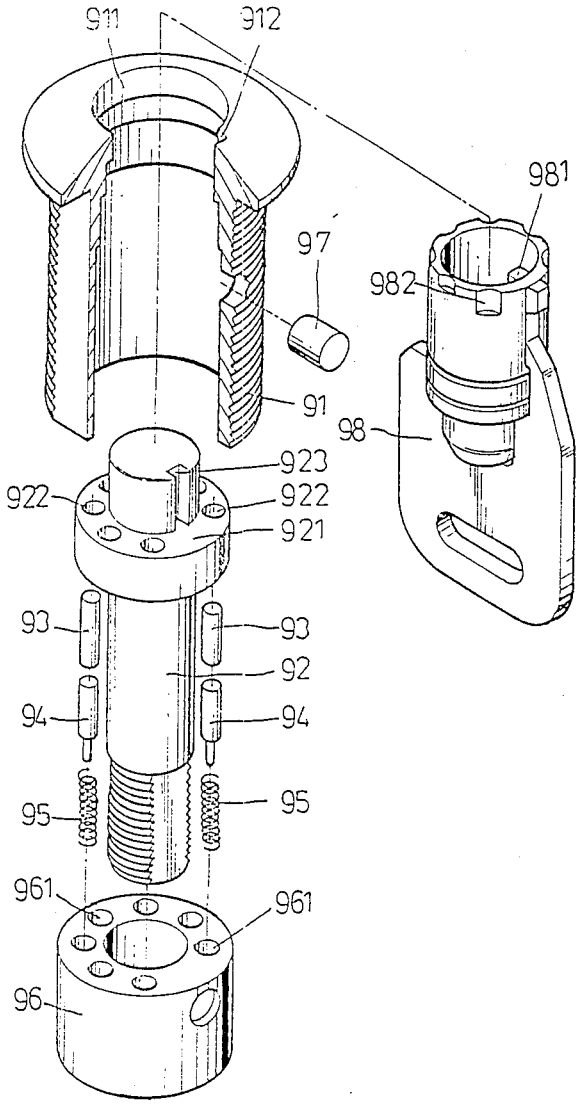
FIG.3 PRIOR ART
FIG. 3 is an exploded view of prior art.

FIG. 3 shows an exploded view of the prior art. The lock of present invention has most of the parts in the prior art except that the prior art uses a recess 923 at the top of the spindle 92 instead of the two protuberances 24 of the present invention to accommodate with the tenon 981 of the valid key 98 for the rotation of the spindle 92 to release the locked position. However, according to the experience, any thief with ordinary skill of this field may easily break such lock by using two hard materials with one inserted into the recess 923 and the other into the groove 912 and rotate the two hard materials in two different directions by force which will create a shearing force to each of the upper plug followers 93, then, by pressing the upper plug followers 93 one after another, the correct depth required to be pressed may easily be found and the lock is, therefore, illegally unlocked.

I claim:

1. A lock comprising:

a cylindrical casing having a key hole opening and plural internal steps at one end thereof of progressively larger diameter than the key hole opening in a direction away from the key hole, and a recess at said opening;

a spindle having an upper plug followers stand at a top third portion thereof, said stand formed with through bores and a plug chamber and an outer ring surface at an upper end thereof;

a lower plug followers stand having plural blind bores;

plural upper plug followers of different length respectively received in said through bores of said upper plug followers stand;

plural lower plug followers of the same length respectively received in said blind bores of said lower plug followers stand;

plural helical compression springs respectively received in said blind bores of said lower plug followers stand to urge portions of said upper plug followers into said plug chamber, said upper plug followers and outer ring surface and lower plug followers stand received against said integral steps, respectively; and a pair of protuberances integrally formed on an upper end of said outer ring of said spindle, wherein when a valid key is inserted into the key hole, a tenon of said key engages between said protuberances and by rotating the key, the tenon will abut a protuberance and the spindle will rotate simultaneously in an unlocking direction.

2. The lock of claim 1, wherein said tenon is formed on an outer circumferential surface of the key, and wherein the height of the protuberances is less than approximately one-half the length of the tenon.

3. The lock of claim 1, wherein said protuberances are semi-spherical projections.

4. The lock of claim 3, wherein said protuberances are closely adjacent each other.

* * * * *